United States Patent [19]

Wu et al.

[11] Patent Number: 4,833,366

[45] Date of Patent: May 23, 1989

[54] HIGH PERFORMANCE HOLLOW CATHODE LAMP

[75] Inventors: Tengzhao Wu; Yingqi Gao; Yongzhang Zhen, all of Beijing, China

[73] Assignee: Beijing General Research Institute for Non-Ferrous Metals, Beijing, China

[21] Appl. No.: 154,763

[22] Filed: Feb. 11, 1988

[30] Foreign Application Priority Data

Feb. 12, 1987 [CN] China ..... 87201859

[51] Int. Cl.[4] ..... H01J 61/09

[52] U.S. Cl. ..... 313/618; 313/614; 313/621; 313/632

[58] Field of Search ..... 313/618, 613, 614, 632, 313/615, 621, 601; 315/98

[56] References Cited

U.S. PATENT DOCUMENTS

| | | | |
|---|---|---|---|
| 3,183,393 | 5/1965 | Paterson | 313/218 |
| 3,264,511 | 8/1966 | Yamasaki | 313/209 |
| 3,433,963 | 3/1969 | Walsh et al. | 313/566 X |
| 3,517,788 | 6/1970 | Sullivan et al. | 313/15 |
| 3,855,491 | 12/1974 | Yamasaki | 313/618 X |
| 4,071,802 | 1/1978 | Yamasaki | 313/209 |
| 4,158,790 | 6/1979 | Sullivan | 313/231.61 |

FOREIGN PATENT DOCUMENTS 8703422 6/1987 World Int. Prop. O. ..... 313/618

OTHER PUBLICATIONS

Lowe, "A High-Intensity Hollow-Cathode Lamp for Atomic Fluorescence," *Spectrochimica Acta,* vol. 26B, pp. 201-205 (1971).

Van Gelder, "New High-Intensity Spectral Source with a Narrow Line Profile", *Applied Spectroscopy,* vol. 22, No. 5, pp. 581-582 (1988).

*Primary Examiner*—David K. Moore
*Assistant Examiner*—Michael Horabik
*Attorney, Agent, or Firm*—Pennie & Edmonds

[57] ABSTRACT

A high performance hollow cathode lamp comprises an common anode and an open-ended hollow cylinder as primary cathode consisting of a selected element adapted to produce a primary electric discharge, which give rise to an atomic vapor of said element by cathode sputtering from the primary cathode, between the anode and the primary cathode. An auxiliary cathode in form of hollow cylinder with one or two open ends is provided to produce a secondary electric discharge. A shielding tube covering the anode and the primary cathode serves to constrain the electron stream of the secondary discharge extending from the auxiliary cathode to the common anode to pass through the primary cathode to excite further the atoms in the vapor to emit radiation characteristic of said element.

10 Claims, 1 Drawing Sheet

HIGH PERFORMANCE HOLLOW CATHODE LAMP

BACKGROUND OF THE INVENTION

The present invention relates to a high performance hollow cathode discharge light source, more particularly to a high performance hollow cathode lamp which is used, for example, in atomic absorption spectral analysis or atomic fluorescence spectral analysis.

At present, the principal light source in atomic absorption spectral analysis is a conventional hollow cathode lamp in which the cathode is in the form of a hollow cylinder with one open end, and is made of a material which contains elements from which the atomic spectrum is to be obtained. As disclosed in U.S. Pat. No. 3,264,511, a hollow cathode and an anode are sealed in an envelope and are positioned at the axis of the lamp and spaced from each other. At the other end of the lamp opposite to the cathode and anode there is a window. All of those parts are in an atmosphere of an inert gas contained in the envelope. The electric discharge between the anode and cathode serves to generate an atomic vapour by sputtering from the cathode, and also to supply excitation, which is necessary for the production of atomic spectra, to at least some of the atoms in the vapour. Such a lamp suffers from the principal disadvantages that those two functions, sputtering and excitation of discharge cannot be controlled separately and a variation in any parameter of the discharge, e.g. current or pressure, will affect both functions. The amount of atomic vapour produced thereby, therefore, must be restricted to a relatively small degree if it is not desired to increase the widths of the spectral lines by self-absorption and resonance broadening. Thus the available discharge current and the degree of excitation that can be imparted to the atomic vapour are similarly limited. Consequently, the intensities of the spectra emitted by such discharge lamp have to be restricted if sharp lines are required.

Both U.S. Pat. Nos. 3,433,963 and 3,517,188 disclose a Sullivan-Walsh type high intensity atomic lamp respectively. Z. Van Gelder described a modified version of the Sullivan-Walsh lamp in "Appl. spectrosc. (22)", P. 581, 1986. U.S. Pat. No. 4,158,790 discloses another kind of high intensity atomic spectral lamp with interchangeable cathode. Those high intensity hollow cathode lamps involve two separate discharge proceedings. One is hollow cathode discharge which produces atomic vapour by sputtering from the internal walls of the hollow cathode and excites thereby part of atomic vapour in negative glow region. The other is low voltage high current discharge which gives rise to further excitation of the sputtered atomic vapour. All of those are provided with a thermal filament auxiliary cathode coated with oxide film from which electrons may be easily emitted so as to produce a large discharge current at low voltage. Taking advantage of such structure, the high intensity hollow cathode lamps above are of high intensity light output, usually four to seventeen times higher than conventional cathode lamps or Sullivan-walsh type, but complicated in structure. They usually require three power supplies. "A high-intensity hollow-cathode lamp for atomic fluorescence", *Spectrochemica Acta,* vol. 26B, pp. 201–205 (1971).

R. M. Lowe discloses a Lowe type high intensity hollow cathode discharge lamp which includes an envelope, an open-ended cylindrical hollow cathode as primary cathode; an oxide-coated thermal filament cathode as auxiliary or booster cathode and a common anode. Above and below the cathode cylinder are mounted plate discharge restricting baffles with only a central hole. The function of these baffles, is to channel the secondary discharge from the oxide-coated cathode above the primary cathode cylinder, through the centre of the cathode cylinder, to the common anode below. Like other high intensity hollow cathode lamps, it requires three power supplies as well. One is a Low-voltage A.C. power supply for heating thermal filament booster cathode; one is a low-voltage high-current discharge power supply for the discharge between the booster cathode and the common anode; and another is primary hollow cathode discharge power supply. Due to the complicated structure, those lamps are difficult to manufacture an high in cost.

SUMMARY OF THE INVENTION

One object of the present invention is to provide a high intensity hollow cathode lamp for atomic absorption spectral analysis or atomic fluorescence spectral analysis, which may be directly used in the existing atomic absorption spectrometer or atomic fluorescence spectrometer, without using any additional power supply.

Another object of the present invention is to provide a high quality spectral light source for atomic absorption spectral analysis or atomic fluorescence spectral analysis which minimizes remarkably the self-absorption and the broadening of the spectral lines and ionic spectral lines as well.

A high performance hollow cathode lamp according to the present invention comprises an envelope; a header sealed at the bottom of the envelope; a window sealed at the top of the envelope; a common anode mounted on the header; a primary hollow cathode positioned above and spaced from the anode, said primary cathode being an open-ended hollow cylinder with one end facing the window to produce a primary discharge; means for shielding the anode and having the primary cathode at the top therein; and an auxiliary hollow cathode for producing a secondary discharge which is constrained by the shielding means to the anode passing through the primary cathode. The envelope is filled with inert gas having certain pressure.

The primary cathode is made of an element adapted to produce a primary electric discharge which gives rise to an atomic vapour of the element by cathode sputtering from the hole of the primary cathode. The auxiliary hollow cathode is a hollow cylinder opened at one or two ends for producing a secondary electric discharge to further excite atoms of the atomic vapour. The shielding or insulating means is provided to constrain the electron stream of the secondary discharge from the auxiliary cathode to the common anode through the hole of the primary cathode. Therefore, high intensity emitted by the lamp of the present invention is increased remarkably and the self-absorption and the broadening of the atomic spectral lines are minimized.

Since the auxiliary cathode is a hollow cylinder instead of thermal filament emitter cathode, it is not necessary to employ an additional power supply for the auxiliary cathode and a low-voltage high-current power supply. The primary cathode and the auxiliary cathode share one power supply which is directly connected with the two cathodes through terminals extending outward the envelope or connected with the two cathodes through two regulation-resistances in or at the outside of the envelope respectively. The positive end of the power supply is then connected to the common anode. Consequently, the high performance hollow cathode lamp according to the present invention has two effective pins on the octal lamp socket (one negative pin and three positive pins) like a conventional hollow cathode lamp. It may be directly used in a commercialized atomic absorption spectrometer or atomic fluorescence spectrometer.

Because of the outstanding structure of the present invention, the discharge parameters of the hollow cathode lamp can be easily regulated by adjusting the two regulation-resistances respectively, whereby to minimize cathode sputtering effect and to increase excitation effect. The exciting discharge and emission take place under the condition where the electron density is high and the atom density is low so that the radiation of the lamp is increased and the self-absorption and the broadening of the atomic spectral lines are minimized.

DESCRIPTION OF THE PREFERRED EMBODIMENT

Figure 2:
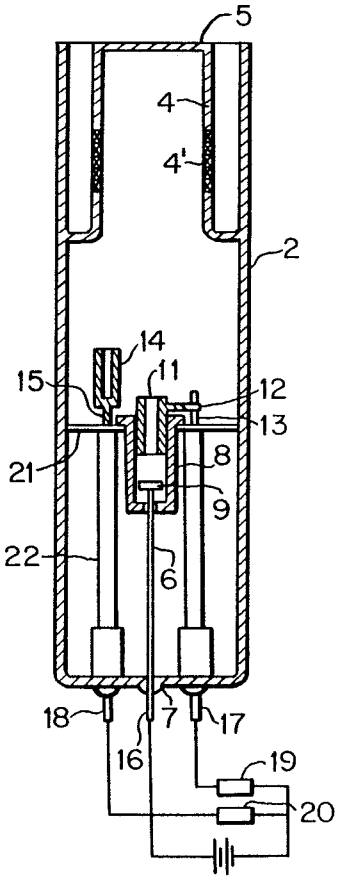
FIG. 2 is a section view of the high performance hollow cathode lamp according to the present invention.

The present invention can be best understood by reference to the embodiment shown in the drawings.

Figure 1:
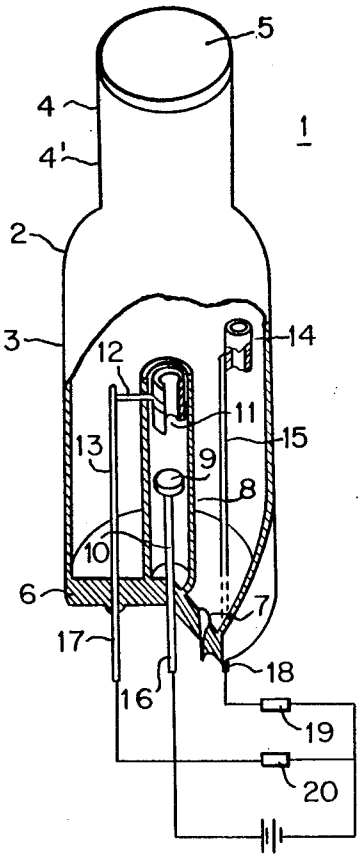
FIG. 1 is a perspective view partly in section of the preferred embodiment of the high performance hollow cathode lamp according to the present invention.

Referring to FIG. 1 and FIG. 2, the high performance hollow cathode lamp 1 of the present invention comprises an envelope 2, a plate window 5 and a header 6. The envelope may be in the form of a tube having an enlarged portion 3 at the lower part and a narrow portion 4 and 4' at the upper part or of a cylinder. The plate window 5 seals the top of the narrow portion. Usually he envelope is made of a material selected from glass or quartz. The portion 4' is a glass-to-quartz transition portion if the envelope is made of glass. But for the long wave atomic spectral lines, no such transition portion 4' need be provided since a glass window is used. The lower end or the bottom of the envelope is sealed by the header 6 having a tipped off exhaust tube 7 which is well known in the art.

Disposed within the envelope 1 and on the header 6, there is an insulating tube 8 which is positioned along the longitudinal axis of the envelope and points toward the window 5. The insulating tube 8 is made of a material such as glass or ceramic functioning as a shield to restrict electron stream or discharge between an anode 9 and a primary cathode 11 therein. The common anode in the form of a disk is mounted on the header by supporting means 10 within the insulating tube. The anode 9 is made of conductive material such as nickel. The supporting means 10 is usually a conductive rod such as tungsten rod which extends outward through the center of the header 6.

For better shielding the common anode 9, a ceramic tube 8, 22 and a thin mica disk 21 with central hole may be also used as shown in FIG. 2.

The primary cathode 11 in the form of an open-ended hollow cylinder is positioned within the top of the insulating tube 8 and at the longitudinal axis of the envelope 1. The cathode 11 is above and spaced from the common anode 9 and supported by a metal rod 20 inserted into the insulating tube 8 through the side wall of the tube. A conductive rod 13 such as tungsten rod connects with and supports to the rod 12, and extends out of the header 6.

An auxiliary cathode 14 is in the form of a hollow cylinder having one or two open ends. The auxiliary cathode 14 is positioned above the primary cathode 11 and is adjacent to the insulating tube 8. The auxiliary hollow cathode 14 is made of conductive material such as titanium. The auxiliary cathode 14 is supported from the header 6 by means of conductive rod 15 such as tungsten rod which extends through the header 6. The insulating tube 8 or an equivalent shielding device is provided to constrain the electron stream originating at the auxiliary cathode 14 to the common anode 9, to pass through the primary cathode 11. The ends of the supporting rods 10, 13 and 15 extending to the outside of the envelope serve as lead-ins 16, 17 and 18.

Only one ,power supply is provided in the present invention. The lead-ins 17 and 18 are connected directly to the negative end of the power or through two regulation-resistances 19 and 20 respectively. The lead-in 16 is connected to the positive end of the power supply. The value of the two resistances 19 and 20 depends on the structure of the lamp and the elements used for the primary cathode. For instance, if a nickel primary cathode is used, the regulation-resistance 20 is 500 ohms and the other 19 is zero ohms. The resistances 19 and 20 may be also constructed or connected in the envelope.

The lamp is evacuated first and then filled with an inert gas such as argon or neon. The envelope is sealed off by means of the exhaust tube 7 in a manner well knows in the art. The pressure therein is preferred in the range of 0.5 to 10 millimeters of mercury.

The high performance hollow cathode lamp of the present invention has been described and shown in the drawings relating to the preferred embodiment. Modifications thereto will become apparent to those skilled in the art. It is intended to cover in the appended claims all such modifications as fall within the true spirit and scope of the invention.

What is claimed is:

1. A high performance hollow cathode lamp comprising an envelope with a header sealed at the bottom of the envelope and filled with an inert gas of predetermined pressure comprising:

a window sealed at the top of the envelope;

a common anode supported on the header;

a primary hollow cathode positioned above and spaced from said anode for producing a primary discharge therebetween, giving rise to an atomic vapor, said primary cathode being an open-ended hollow cylinder with one end facing the window;

insulative means mounted to said head for surrounding and shielding said anode, said anode being disposed within a lower part of said insulative means, and said primary cathode being positioned within an upper part of said insulative means; and an auxiliary hollow cathode for producing a secondary discharge, said secondary discharge being constrained by said shielding means to pass through said hollow primary cathode to reach said anode, so as to further excite the atomic vapor.

2. The hollow cathode lamp set forth in claim 1, wherein said primary hollow cathode and said common anode are positioned along the longitudinal axis of the envelope.

3. The hollow cathode lamp set forth in claim 2, wherein said primary cathode is supported by supporting means passing through the side wall of the insulative means and extending outwardly of the header.

4. The hollow cathode lamp set forth in claim 2, wherein said anode is supported from the header by supporting means extending outwardly through the center of the header.

5. The hollow cathode lamp set forth in claim I, wherein said insulative means is made of a material selected from glass, ceramic and mica.

6. The hollow cathode lamp set forth in claim 1, wherein said auxiliary cathode is a hollow cylinder with one or two open ends.

7. The hollow cathode lamp set forth in claim 1, wherein said auxiliary cathode is adjacent to said insulative means and spaced radially from the primary cathode.

8. The hollow cathode lamp set forth in claim 7, wherein said auxiliary cathode is positioned above the primary cathode, but off the axis of the envelope.

9. The hollow cathode lamp set forth in claim 1, wherein said primary cathode and said auxiliary cathode are connected to the negative pole of a power supply and said anode is connected to the positive pole of the power supply.

10. The hollow cathode lamp set forth in claim 1, wherein said primary cathode and said auxiliary cathode are connected to the negative pole of a power supply through two regulation-resistances respectively and said anode is connected to the positive pole of the power supply.

* * * * *